US007084757B2

(12) United States Patent
Terui

(10) Patent No.: US 7,084,757 B2
(45) Date of Patent: Aug. 1, 2006

(54) PORTABLE TERMINAL AND INFORMATION PROVISION SYSTEM UTILIZING THE PORTABLE TERMINAL

(75) Inventor: Koichi Terui, Yokohamama (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/626,614

(22) Filed: Jul. 25, 2003

(65) Prior Publication Data

US 2004/0189489 A1 Sep. 30, 2004

(30) Foreign Application Priority Data

Mar. 27, 2003 (JP) ..... 2003-086917

(51) Int. Cl.
*G08B 23/00* (2006.01)
*G08G 1/09* (2006.01)
*G08G 1/16* (2006.01)

(52) U.S. Cl. ..... 340/539.11; 340/539.13; 340/573.1; 340/573.4; 340/436; 340/944

(58) Field of Classification Search ..... 340/359.1, 340/539.11, 539.13, 539.15, 573.1, 573.4, 340/435, 436, 903, 988, 944; 701/301, 117; 455/456.1

See application file for complete search history.

(56) References Cited

U.S. PATENT DOCUMENTS 4,611,198 A * 9/1986 Levinson et al. ..... 340/539.11
5,021,794 A * 6/1991 Lawrence ..... 342/457
5,218,344 A * 6/1993 Ricketts ..... 340/573.4
5,396,227 A * 3/1995 Carroll et al. ..... 340/825.36
5,461,390 A * 10/1995 Hoshen ..... 342/419
5,905,461 A * 5/1999 Neher ..... 342/357.07
5,973,618 A * 10/1999 Ellis ..... 340/990
5,982,281 A * 11/1999 Layson, Jr. ..... 340/539.13
6,169,484 B1 * 1/2001 Schuchman et al. ..... 340/573.1
6,243,039 B1 * 6/2001 Elliot ..... 342/457
6,459,365 B1 10/2002 Tamura ..... 340/425.5
6,720,881 B1 * 4/2004 Halliday ..... 340/573.4
6,861,959 B1 * 3/2005 Torres Sabate et al. ..... 340/944
2001/0048364 A1 * 12/2001 Kalthoff et al. ..... 340/573.1
2003/0016143 A1 * 1/2003 Ghazarian ..... 340/901

FOREIGN PATENT DOCUMENTS

JP A-11-353592 12/1999
JP A-2001-338 386 7/2001
JP A-2001-338386 12/2001
JP A-2002-352 395 6/2002

(Continued)

*Primary Examiner*—Jeffery Hofsass
*Assistant Examiner*—Anne V. Lai
(74) *Attorney, Agent, or Firm*—Mattingly Stanger Malur & Brundidge, P.C.

(57) ABSTRACT

A portable terminal comprising a transmission part that transmits to information provision equipment or a server, a signal indicating presence at a prescribed location, presence of a communications counterparty at a prescribed location, a reception part that receives from the information provision equipment or the server, a signal indicating the position of a moving body, a moving body is approaching or is present at the prescribed location, an alarm part that issues an alarm using the moving body in position signal received at the reception part, indicating the moving body is approaching or is present at the prescribed location, a light detection part detecting the degree of brightness, a part deciding whether or not to transmit a present in prescribed location signal that decides, using the brightness as detected by the light detection part, whether or not to send a present in prescribed location signal from the transmission part.

8 Claims, 6 Drawing Sheets

FOREIGN PATENT DOCUMENTS

| | | |
|---|---|---|
| JP | A-2002-165264 | 6/2002 |
| JP | A-2002-165264 | 7/2002 |
| JP | A-2002-352395 | 12/2002 |

* cited by examiner

PORTABLE TERMINAL AND INFORMATION PROVISION SYSTEM UTILIZING THE PORTABLE TERMINAL

BACKGROUND OF THE INVENTION

This invention relates to a portable terminal that issues an alarm under prescribed conditions and an information provision system that utilizes the portable terminal.

Inventions wherein, in order to prevent an accident by collision with a pedestrian or another vehicle, in response to conditions an appropriate alarm is issued to the driver of the other vehicle or the pedestrian, have been disclosed (see for example the abstract of JP-A-2001-338386 at 0098).

In technology according to the prior art, an alarm is issued coordinated to the date and the surrounding weather conditions when a weak electric wave is received (JP-A-2001-338386 at 0006). In technology according to the prior art however, although an alarm is issued coordinated to the date and weather conditions, while the degree of brightness during the same time period may change depending on the season or while the degree of brightness may vary in different areas or in certain locations according to the weather, the issuance of the alarm is not coordinated to these variables.

SUMMARY OF THE INVENTION

Accordingly, the object of the present invention is to solve these problems affecting technology of the prior art by providing a portable terminal that brings improved convenience to the user.

In order to achieve the above object the present invention provides a portable terminal comprising; a transmission part that transmits to information provision equipment or a server, a signal indicating presence at a prescribed location, a reception part that receives from the information provision equipment or the server, a signal indicating the position of a moving body indicating that a moving body is approaching the prescribed location or is present at the prescribed location, an alarm part that issues an alarm using the moving body in position signal received at the reception part, to indicate that the moving body is approaching the prescribed location or is present at the prescribed location, a light detection part that detects the degree of brightness, a part that decides whether or not to transmit the present in prescribed location signal that decides, using the brightness as detected by the light detection part, whether or not to send a present in prescribed location signal from the transmission part.

The present invention provides a portable terminal with an improved level of convenience and an information provision system that utilizes that portable terminal.

Other objects, features and advantages of the invention will become apparent from the following description of the embodiments of the invention taken in conjunction with the accompanying drawings.

DETAILED DESCRIPTION OF THE INVENTION

Embodiments of the present invention will now be described with reference to the drawings. The concept behind the operation of the invention will be described with reference to the drawings. The same reference symbols are applied to parts that perform the same function.

Figure 1:
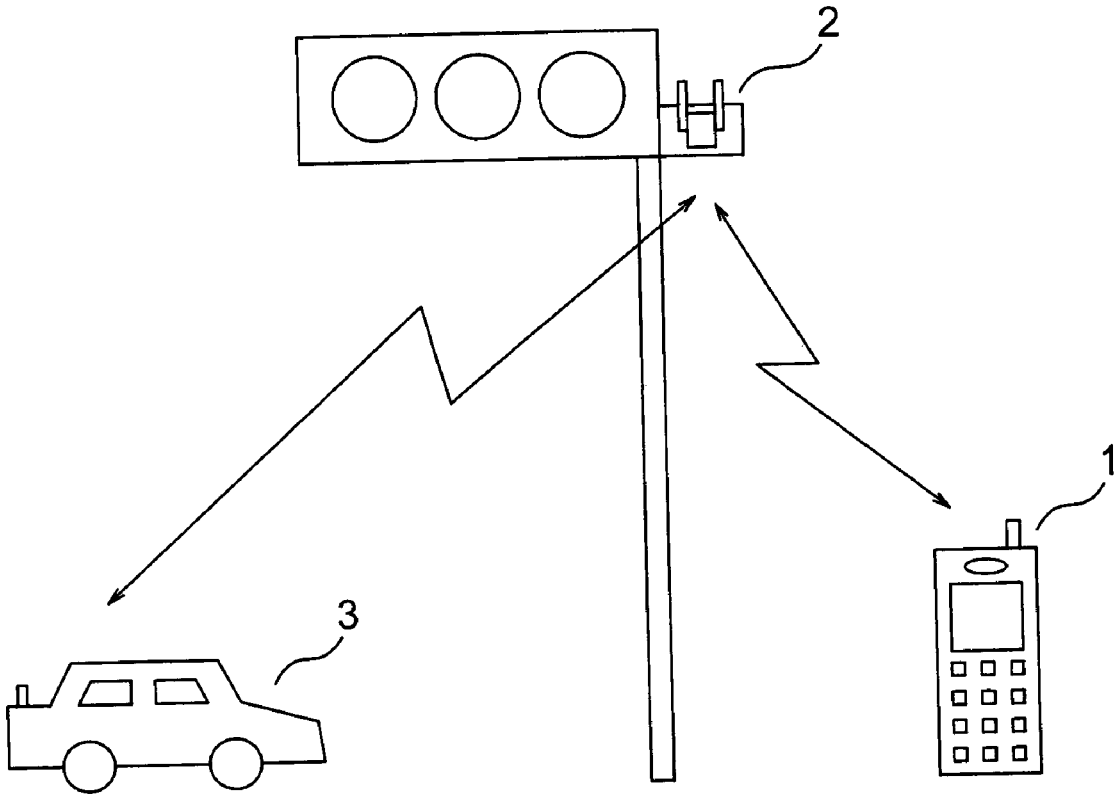
FIG. 1 is a schematic illustration of a configuration of an information provision system according to an embodiment of the present invention.

FIG. 1 is a schematic illustration of a configuration of an information provision system according to an embodiment of the present invention. There, the system comprises portable terminal 1, safety information provision equipment 2, portable terminal 3 that goes together with a movable body such as a motor bike for example and server 4. In the following description safety information provision equipment 2 that provides safety information is used as an example of safety information provision equipment 2, however equipment providing information not restricted to safety information is also suitable.

The operations of portable terminal 1, safety information provision equipment 2 and portable terminal 3 will now be described with reference to the drawings.

Figure 2:
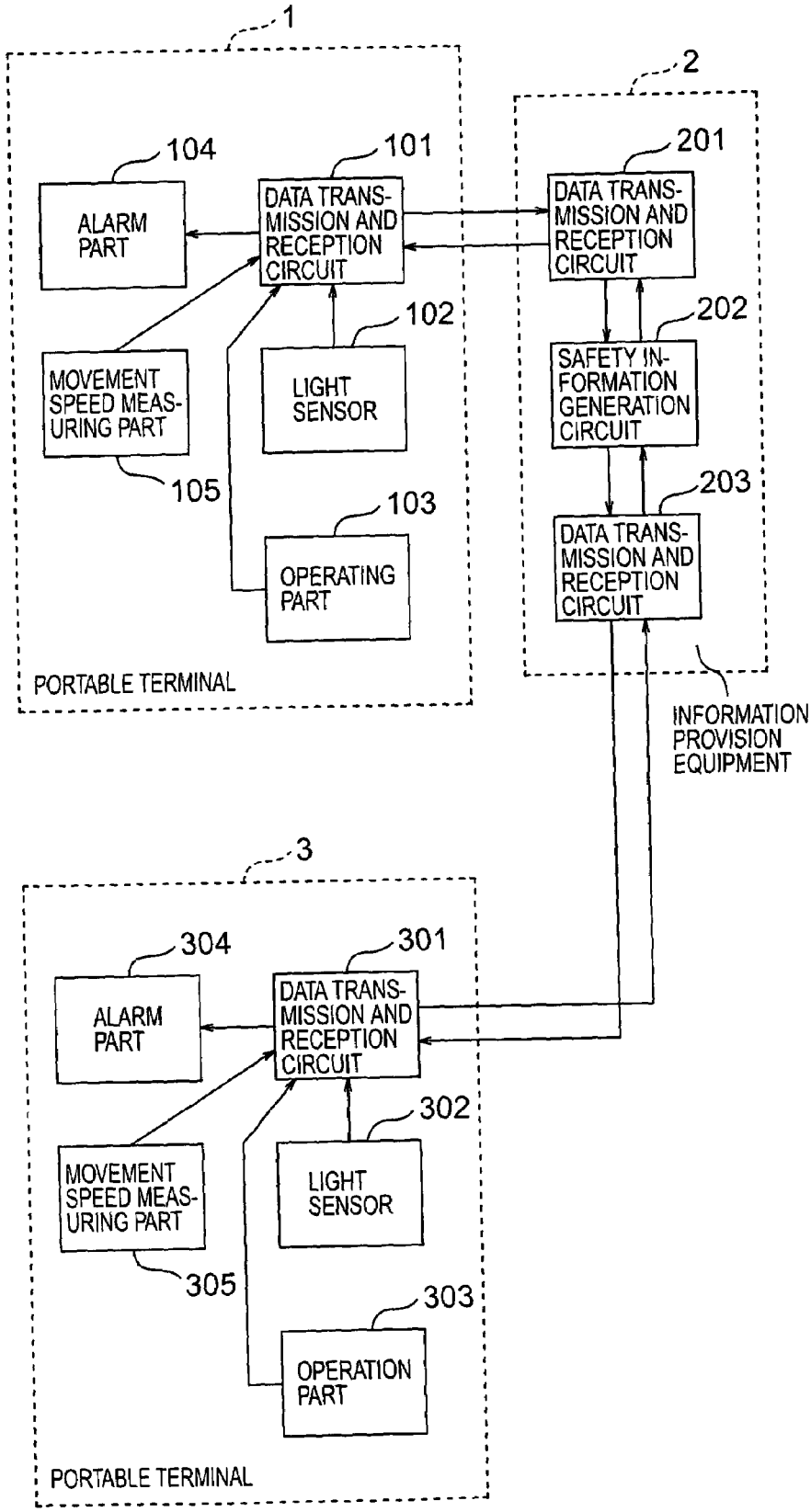
FIG. 2 is a schematic illustration of a configuration of an information provision system according to an embodiment of the present invention.

FIG. 2 is a schematic illustration of a configuration of an information provision system according to an embodiment of the present invention.

Portable terminal 1 provides data transmission and reception circuit 101, alarm part 104, light sensor 102, movement speed measuring part 105 and operation part 103. The carrier of portable terminal 1, a pedestrian or person riding a bicycle for example, is a body that travels at a comparatively slow speed. The carrier of portable terminal 3, is a body traveling in or riding a vehicle such as an automobile or motor bike and the like that travels at a high speed.

Data transmission and reception circuit 101 performs transmission and reception with transmission and reception circuit 201 of safety information provision equipment 2 as shown in FIG. 2. Alarm part 104 displays an image using a display means such as liquid crystal for example and/or issues an alarm through sound and/or through vibrations from a vibe. Light sensor 102 detects brightness based on either the level of illuminance, the intensity of brightness or the light intensity or based on a combination of those three.

Safety information provision equipment 2 provides data transmission and reception circuit 201, safety information generation circuit 202 and data transmission and reception circuit 203. Data transmission and reception circuit 201 or data transmission and reception circuit 203 perform a search over a constant area of space for ascertaining whether or not a desired communications counterparty is present within the range in which data transmission is possible, and perform transmission and reception of data for portable terminal 1 or portable terminal 3 respectively. Safety information generation circuit 202 generates safety information based on data obtained from portable terminal 1 or portable terminal 3 via data transmission and reception circuit 201 or data transmission and reception circuit 203.

Safety information may be just information conveying the fact that there is danger or it may be more concrete information such as for example "there is a pedestrian ahead on the left" or "a car is approaching from the rear." Where this concrete information is provided however, it is necessary to discriminate whether the respective entities with portable terminal 1 and portable terminal 3 are a slow moving body like a pedestrian or a high speed moving body with an automobile. Accordingly, portable terminal 1 and portable terminal 3 are each able to be installed with movement speed measuring part 105 that measures their respective movement speeds, and as these moving speeds measured by movement speed measuring part 105 are received respectively at data transmission and reception circuit 201 and data transmission and reception circuit 203, the fact of whether the carrier of portable terminal 1 is a slow moving body and the carrier of portable terminal 3 is a high speed moving body can be detected and appropriate message data can be provided from safety information provision equipment 2. Thus, whether the carrier of the portable terminal is a slow moving body or a high speed moving body can be detected without the carrier of the portable terminal being aware of it. Further, by operating operation part 103 the carrier of a terminal can make a setting indicating whether he/she is a slow moving body or a high speed moving body or any other means may be used that enables safety information provision equipment 2 to ascertain the movement speed of the carrier of a portable terminal.

The configuration of portable terminal 3 may be the same as that for portable terminal 1 shown in FIG. 2, however it is suitable to make the display of alarm part 304 of portable terminal 3 larger and easier to view. Further, portable terminal 3 may be connected to a car navigation system not shown in the drawing, enabling information from the portable terminal to be viewed on the car navigation system display. In this situation, whereas the configuration of portable terminal 3 is the same as that for portable terminal 1, it is easy for the person riding in the moving body to view the safety information as it is visible on a large display.

Figure 3:
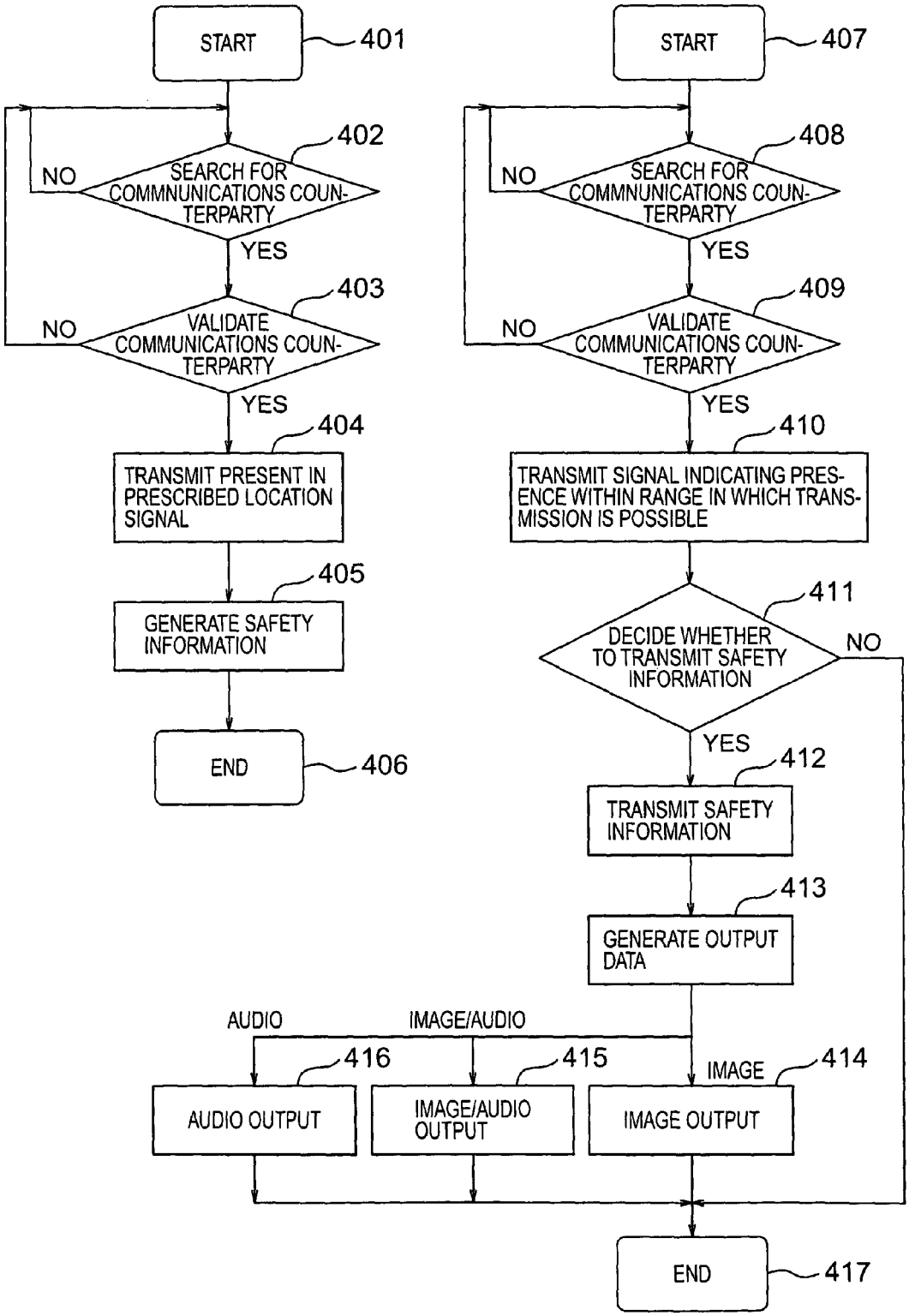
FIG. 3 shows the flow of operations according to an embodiment of the present invention.

The operations of a first embodiment according to the present invention will now be described with reference to FIG. 3. Data transmission and reception circuit 201 of safety information provision equipment 2 performs a search over a constant area of space for ascertaining whether or not a desired communications counterparty is present within the range in which data transmission is possible (402). If portable terminal 1 is within the range in which data transmission is possible with safety information provision equipment 2, in response to a request from data transmission and reception circuit 201, data transmission and reception circuit 101 of portable terminal 1 commences data transmission and reception and performs validation (403). After validation, if brightness detected by light sensor 102 is below the prescribed level of brightness, data transmission and reception circuit 101 adds information on movement speed obtained from movement speed measuring part 105 as necessary, and transmits a signal to data transmission and reception circuit 201 indicating the fact that portable terminal 1 is within the range in which transmission is possible with safety information provision equipment 2 (404). That is to say, data transmission and reception circuit 101 transmits a signal notifying that portable terminal 1 is in a location which is within the range in which transmission is possible. If the level of brightness detected by light sensor 102 is below the prescribed level, as data transmission and reception circuit 101 is transmitting data to data transmission and reception circuit 201, data transmission and reception circuit 101 can prevent the provision of for example unnecessary safety information where the location is one where there is a comparatively high degree of brightness so it would be comparatively difficult for an accident to occur. The setting for what is below the prescribed level of brightness can be performed by the user operating operation part 103. Further, based on the brightness as detected by light sensor 102, the decision on whether or not transmission should be performed can be made by a transmission decision part, not shown in the drawing, inside data transmission and reception circuit 101, or this decision can be made by a transmission decision part separate from data transmission and reception circuit 101.

Based on the signal received at data transmission and reception circuit 201, safety information generation circuit 202 generates safety information to which is added information on the position of safety information provision equipment 2 (405).

Data transmission and reception circuit 203 also performs a search over a constant area of space for ascertaining whether or not a desired communications counterparty is present within the range in which data transmission is possible (408). If portable terminal 3 is within the range in which transmission is possible with safety information provision equipment 2, in response to a request from data transmission and reception circuit 203, data transmission and reception circuit 301 of portable terminal 3 commences data transmission and reception and performs validation (409). After validation, data transmission and reception circuit 301 adds information on movement speed obtained from part 305 as necessary, and transmits a signal to data transmission and reception circuit 203 indicating the fact that portable terminal 3 is within the range in which transmission is possible with safety information provision equipment 2 (410). For portable terminal 3, data transmission and reception circuit 203 transmits safety information generated by safety information generation circuit 202 to data transmission and reception circuit 301 of portable terminal 2 (412).

Based on the safety information to which is added information on the position of safety information provision equipment 2 as received at data transmission and reception circuit 301, portable terminal 3 generates data for output for issuing an alarm at alarm part 304 (413). If the output data thus generated is image data, the image is displayed on the image display part of alarm part 304 (414), if that output data is image data and audio data, the image is output on the image display part of alarm part 304 and the audio is output from the audio output part of alarm part 304 (415), and if that output data is audio data the audio is output from the audio output part of alarm part 304 (416). The carrier of portable terminal 3 is alerted through these alarm methods. The carrier of portable terminal 3 is made aware of the location requiring care because information on the position of safety information provision equipment 2 is added and the notification is made combining that information on position. This brings added convenience.

Further, after the signal notifying the fact that portable terminal 3 is within the range in which transmission is possible with safety information provision equipment 2 is received at data transmission and reception circuit 203 of safety information provision equipment 2 (410), it is suitable for safety information generation circuit 202 to generate safety information and transmit that information to data transmission and reception circuit 101 of portable terminal 1 from data transmission and reception circuit 201. When data transmission and reception circuit 101 receives this safety information the carrier of portable terminal 1 can be alerted through alarm part 104 either by information displayed on alarm part 104, by audio output or by a vibration.

It is envisaged that the carrier of portable terminal 1 would be a slow moving body like a pedestrian or a person riding a bicycle moving at a speed that is not very fast while the carrier of portable terminal 3 would be a high speed moving body like a car or motorbike for example moving at a comparatively fast speed. Accordingly, while on the one hand long distance transmission is required to the carrier of portable terminal 3 more so than for the carrier of portable terminal 1, if fairly long distance transmission is made to the carrier of portable terminal 1, that would result in the carrier of portable terminal 1 being alerted when there is actually no danger and therefore no necessity to alert that carrier. Accordingly, the range over which transmission is possible with data transmission and reception circuit 201 of safety information provision equipment 2 is narrower than the possible transmission range of data transmission and reception circuit 203, as it is appropriate that the carrier genuinely facing a possibility of danger is the one to be alerted. That is to say, when the moving body approaches or is present in a location that is within the range in which transmission is possible between safety information provision equipment 2 and portable terminal 1, transmits a moving body in position signal.

Further, when the range in which transmission is possible is the same for both data transmission and reception circuit 201 and data transmission and reception circuit 203 it is possible to prevent unnecessary alerts being issued or to limit excessive traffic as follows. At safety information generation circuit 202 of safety information provision equipment 2 receiving a signal notifying the fact that portable terminal 1 is within the range in which transmission is possible with safety information provision equipment 2, a decision can be made coordinated to the traveling speed of portable terminal 1 on whether or not to generate safety information. That is to say, the slower the traveling speed of portable terminal 1 the slower the decrease in the distance between safety information provision equipment 2 and portable terminal 1 and when, in response to this, no decision is made that the carrier of portable terminal 1 has entered a region of danger, a signal is not transmitted to portable terminal 3. Further, it is suitable that, rather than portable terminal 1 notifying the fact that portable terminal 1 has entered the range within which transmission is possible with safety information provision equipment 2, portable terminal 1 in coordination with the traveling speed as measured by movement speed measuring part 105, may transmit to safety information provision equipment 2 a signal notifying the fact that the carrier of 1 has entered a region of danger. In other words, the slower the traveling speed of portable terminal 1 the slower the decrease in the distance between safety information provision equipment 2 and portable terminal 1 and when, in response to this, no decision is made that the carrier of portable terminal 1 has entered a region of danger, a signal is not transmitted to safety information provision equipment 2. The distance between safety information provision equipment 2 and portable terminal 1 can be detected for example through the time required for transmission of radio waves from safety information provision equipment 2 to portable terminal 1 or through a comparison of information on position of safety information provision equipment 2 and information on position generated by position information generation circuit 106 described subsequently.

It is not necessary for light sensor 102 to be integrated with portable terminal 1. It is suitable for light sensor 102 to be detached from portable terminal 1 and for communication to occur between portable terminal 1 and light sensor 102 using a means for short distance communication like bluetooth for example. Where this detachment is possible the main unit of portable terminal 1 may be placed in a bag for example while light sensor 102 is placed outside, operating independently. This brings an improved level of convenience. Further, light sensor 102 and portable terminal 1 can be completely separate and independent which in turn provides greater scope of freedom in the design of light sensor 102 as fewer structural limitations are presented.

In the above description of an embodiment of the present invention, a light sensor is used to determine whether or not a present in prescribed location signal notifying that a communications counterparty is present at a prescribed location should be transmitted, however a light sensor can also be used in connection with a determination of whether or not to receive a moving body in position signal notifying that a moving body is approaching or is present at that location or in connection with a determination on whether or not to issue an alarm after such reception of that signal. It may happen that when a present in prescribed location signal is to be sent if the light sensor is obstructed and makes an erroneous decision that the environment is dark or if, temporarily, the terminal carrier is present in a dark location, unnecessary safety information may not be prevented from being provided.

Figure 4:
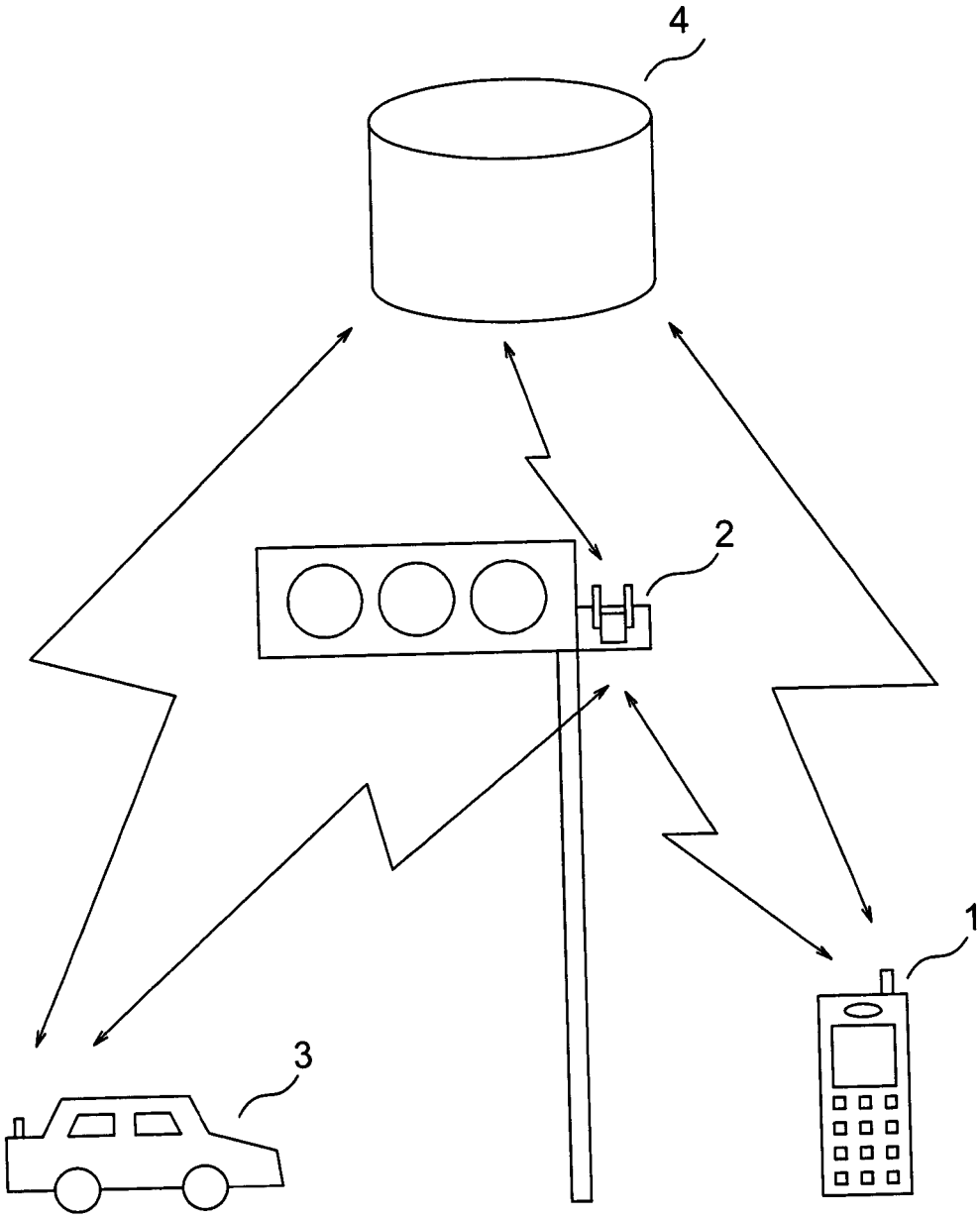
FIG. 4 is a schematic illustration of a configuration of an information provision system according to an embodiment of the present invention.
Figure 5:
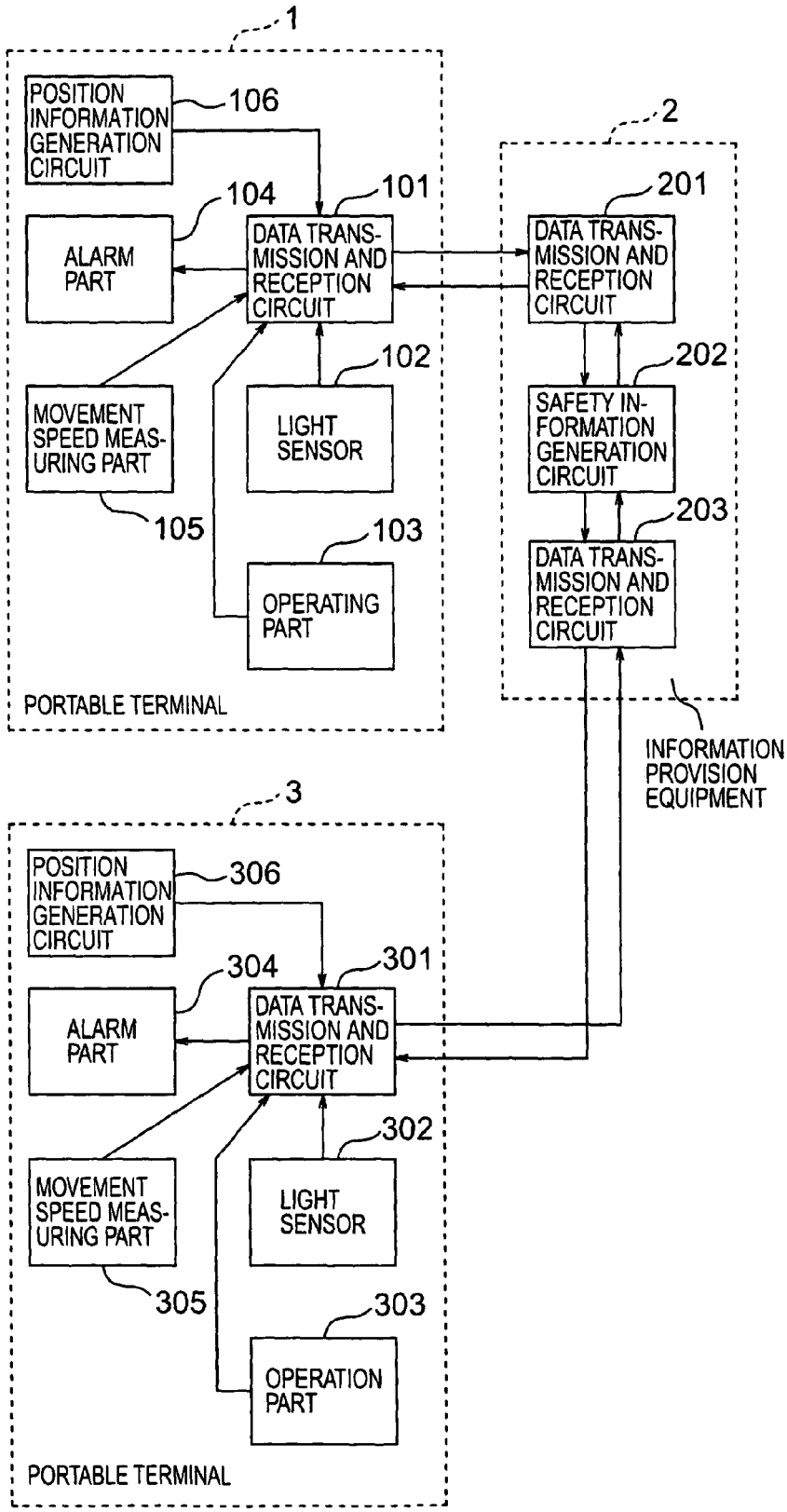
FIG. 5 is a schematic illustration of a configuration of an information provision system according to an embodiment of the present invention.

A second embodiment according to the present invention will now be described with reference to FIG. 4 and FIG. 5. Referring to FIG. 4, the safety information provision system for this second embodiment comprises portable terminal 1, portable terminal 3 and server 4. It is suitable with this second embodiment for no safety information provision equipment 2 to be provided so that the functions performed by safety information provision equipment 2 are performed by server 4.

Server 4 is connected to a network and ascertains traffic conditions or weather conditions etc. at prescribed locations.

Further, server 4 possesses a map database and can provide information showing the location of portable terminal 1 or portable terminal 3 on a map to portable terminal 1 or portable terminal 3.

Portable terminal 1 for this second embodiment comprises data transmission and reception circuit 101, alarm part 104, movement speed measuring part 105, operation part 103 and position information generation circuit 106. Embodiment 2 differs to embodiment 1 in that embodiment 2 comprises position information generation circuit 106. With this second embodiment light sensor 102 is not an essential part of the configuration.

Position information generation circuit 106 generates information on the position of portable terminal 1 through positioning using GPS (Global Positioning System) or using a base station that performs communication with portable terminal 1.

The operations according to the second embodiment of the present invention will now be described. Portable terminal 1 and portable terminal 3 generate position information on their current position through position information generation circuit 106. Portable terminal 1 and portable terminal 3 regularly transmit this generated position information to server 4. Server 4 makes a decision as to whether or not the position received for portable terminal 1 and portable terminal 3 is in a region of danger such as a location where accidents frequently occur or beside a construction site for example. If server 4 decides that both terminals are in a region of danger, server 4 transmits information to both those terminals indicating that there is danger (that is to say, information that portable terminal 1 is in a region of danger). Both terminals to which that information indicating danger is transmitted issue an alarm at alarm part 104 through an image shown on the display of part 104 or through an audio alarm or vibrations from a vibe.

As server 4 decides when there is danger the system can be made to provide flexibility considering overall such things as changes in weather conditions, the frequency of the occurrence of accidents and traffic conditions and the like and making settings prescribing which situations give rise to danger. Because server 4 generates safety information based on for example constantly changing weather and traffic conditions, there is no need to generate unnecessary safety information. Making such settings prevents this from occurring thereby preventing the concomitant result of an increase in communications traffic over the system. The settings on danger can be selected for such things as location, time and weather conditions.

A third embodiment according to the present invention will now be described. The safety information provision system according to this third embodiment comprises portable terminal 1, portable terminal 3, safety information provision equipment 2 and server 4 (referring to FIG. 4).

Portable terminal 1 according to this embodiment comprises data transmission and reception circuit 101, operation part 103 and alarm part 104. Light sensor 102 and position information generation circuit 106 are not required for this configuration.

Because the position of safety information provision equipment 2 is basically fixed server 4 is constantly ascertaining the position of safety information provision equipment 2 or is ascertaining the position of safety information provision equipment 2 through information on its position provided from safety information provision equipment 2. Further, server 4 ascertains such things as weather conditions, the frequency of occurrence of accidents and traffic conditions for example. Accordingly, server 4 can provide to safety information provision equipment 2 information on traffic conditions, the frequency of occurrence of accidents and weather conditions and the like at the current position of safety information provision equipment 2.

Based on information about the weather, frequency of occurrence of accidents and traffic conditions circuit 202 of safety information provision equipment 2 decides whether or not to generate safety information. Because circuit 202 is generating safety information (that is to say, information that portable terminal 1 is in a region of danger) based on for example constantly changing weather and traffic conditions, there is no need to generate unnecessary safety information, thereby preventing an increase in communications traffic that would result if such unnecessary safety information were generated. Circuit 202 decides whether or not safety information is generated but it is also suitable for that decision to be made at server 4, which enables safety information provision equipment 2 to be constructed more simply. Further, it is suitable for server 4 to transmit safety information directly to portable terminal 1 and portable terminal 3.

In contrast to the second embodiment, with this third embodiment position information can be easily ascertained from the position of safety information provision equipment 2. Accordingly, though position information is not measured at portable terminal 1 or portable terminal 3, as position information can be ascertained at server 4 a decision on conditions can be made at server 4, or can provide information on conditions to safety information provision equipment 2, thus allowing flexible coordination in response to the fact of portable terminal 1 being in a dangerous position.

Figure 6:
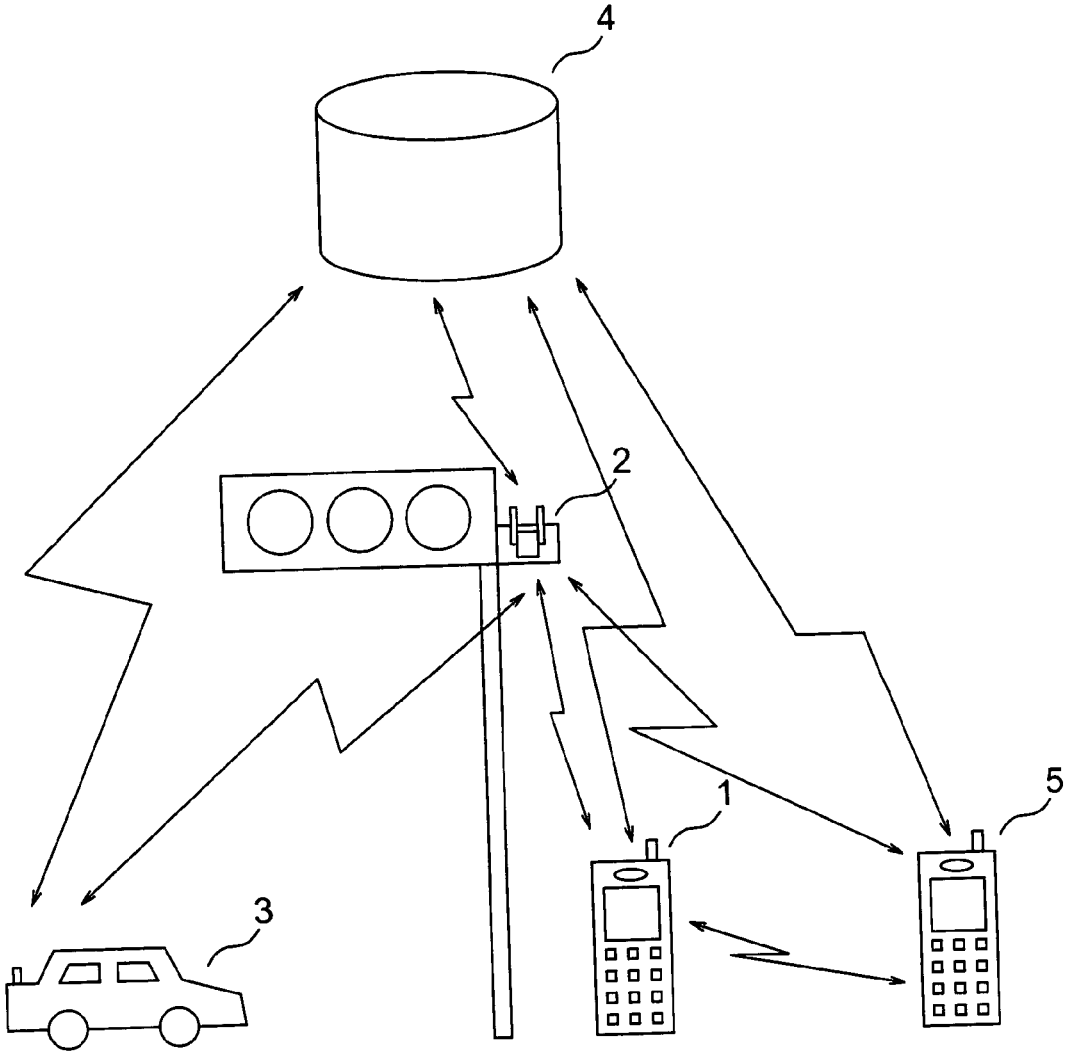
FIG. 6 is a schematic illustration of a configuration of an information provision system according to an embodiment of the present invention.

A fourth embodiment according to the present invention will now be described. The safety information provision system of this fourth embodiment comprises portable terminal 1, portable terminal 3, safety information provision equipment 2 and terminal 5 (referring to FIG. 6).

Portable terminal 1 and portable terminal 5 are of the same function. Carriers of the portable terminal 1 are supposed to be children and/or elder persons and carriers of the portable terminal 5 are their parents and/or caregiver.

For this embodiment portable terminal 1 comprises data transmission and reception circuit 101, operation part 103 and alarm part 104. Light sensor 102 and position information generation circuit 106 are not essential for this embodiment.

When data transmission and reception circuit 101 of portable terminal 1 can communicate over a short distance with data transmission and reception circuit 101 of portable terminal 5, data transmission and reception circuit 101 of portable terminal 1 does not make a reply in response to a search from data transmission and reception circuit 201 of safety information provision equipment 2 on whether or not communication is possible. Basically, data transmission and reception circuit 101 performs regular searches to ascertain whether or not terminal 5 is in close proximity and if terminal 5 is in close proximity, stores information that terminal 5 is in close proximity in a data transmission and reception decision circuit not shown in the drawing. When data transmission and reception decision circuit receives a search from data transmission and reception circuit 201 of safety information provision equipment 2 on whether or not is within the range within which transmission is possible, even if is within that range, when terminal 5 is in close proximity data transmission and reception circuit 101 of portable terminal 1 is a circuit that decides not to transmit data. Alternatively, even if data transmission and reception circuit 101 does perform transmission, data transmission and reception circuit 101 instructs data transmission and reception circuit 202 of safety information provision equipment 2 not to generate safety information. In this way provision of safety information can be automatically prevented in situations where it is not required, when for example the carrier of terminal 5 is a caregiver for the carrier of portable terminal 1 who is for example a child, under supervision and monitored by that caregiver. This enables an unnecessary increase in communications traffic to be prevented.

Further, when server 4 performs the role of safety information provision equipment 2, if the data transmission and reception decision circuit can communicate in close proximity with terminal 5, data transmission and reception circuit 101 does not transmit to server 4 or if it does transmit, it instructs server 4 not to provide safety information.

Again, it is suitable that no decision be made on whether or not to generate safety information at the portable terminal 1 side and at the side of safety information provision equipment 2 or server 4 that ascertain position information of portable terminal 1 and terminal 5 the decision on whether or not to generate the safety information can be made based on where portable terminal 1 and terminal 5 are positioned with respect to each other. However, at the very least when operating without safety information provision equipment 2 and only server 4, in order for the respective positions of portable terminal 1 and terminal 5 to be ascertained, each of those terminals must have a position information generation circuit 106. So configured, even though there is no safety information provision equipment 2 it is still possible to construct a safety information provision system that can automatically prevent provision of unnecessary safety information.

In the above description of the embodiments according to the present invention the system is configured to transmit safety information when both portable terminal 1 and portable terminal 3 are within the range within which transmission is possible, however it is possible to enable transmission of safety information when only one terminal is within the range within which transmission is possible. Safety information can be transmitted even when a pedestrian or moving body that is a person riding in a car for example is not carrying portable terminal 1 or portable terminal 3.

Further, data transmission and reception circuit 201 and data transmission and reception circuit 203 of safety information provision equipment 2 can be configured separately and it is suitable for each of those separate individual configurations to perform their respective functions independently. This allows a more simplified configuration with subsequent cost reductions.

Moreover, when data transmission and reception circuit 101 transmits data to data transmission and reception circuit 201 of safety information provision equipment 2, it is suitable that the data be transmitted with data on the carrier of the terminal added. If the carrier of portable terminal 1 is a person that speaks a different language from the country he is in, safety information can then be provided using the language of that person in accordance with the data on the carrier of the terminal.

The above description of the present invention illustrates embodiments showing examples wherein the system is configured for regular searches performed by the safety information provision equipment however a configuration wherein a sensor like an infrared ray sensor is used and validation is performed or a search is commenced only in response to the sensor is also conceivable.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A portable terminal comprising:

a transmission part that transmits, to information provision equipment or a server, a signal indicating presence at a prescribed location, indicating presence of a communications counterparty at a prescribed location;

a reception part that receives from said information provision equipment or said server a signal indicating the position of a moving body indicating that a moving body is approaching or is present at said prescribed location;

an alarm part that issues an alarm, using the moving body in position signal received at said reception part, to indicate that said moving body is approaching or is present at said prescribed location;

a light detection part that detects the degree of brightness; and a part that decides whether or not to transmit a signal present indication in prescribed location signal and that decides, using the brightness as detected by said light detection part, whether or not to send a present indication in prescribed location signal from said transmission part.

2. A portable terminal according to claim 1, wherein said transmit decision part transmits a present in prescribed location signal from said transmission part when the level of brightness detected by said light detection part is below a fixed level.

3. A portable terminal according to claim 2, wherein said fixed level can be set.

4. A portable terminal according to claim 1, wherein said light detection part can be detached from the main body of the portable terminal.

5. A portable terminal comprising:

a transmission part that transmits to information provision equipment or a server a signal indicating presence at a prescribed location, indicating presence of a communications counterparty at a prescribed location;

a reception part that receives, from said information provision equipment or said server, a signal indicating the position of a moving body indicating that a moving body is approaching or is present at a prescribed location; and an alarm part that issues an alarm, using the moving body in position signal received at said reception part to indicate that said moving body is approaching or is present at said prescribed location, wherein if said reception part receives a specified presence signal from a specified portable terminal informing that the specified terminal is present or in close proximity to said prescribed location, then said transmission part does not transmit a present indication in prescribed location signal.

6. An information provision system comprising:

a first portable terminal;

a second portable terminal that moves together with a moving body; information provision equipment; and a server, wherein said first portable terminal and said second portable terminal each transmits moving speed information of said terminal to said information provision equipment, wherein said information provision equipment notifies said server with said moving speed information that said first portable terminal is near said information provision equipment when said first portable terminal is near said information provision equipment, and wherein said server uses said moving speed information, the current position of said information provision equipment and information on danger affecting said current position to notify said second portable terminal that said first portable terminal is in a region of danger.

7. An information provision system according to claim 6, wherein said moving speed information includes whether information indicating said first and second portable terminal is moving in a low speed or in a high speed.

8. An information provision system according to claim 6, wherein said server notifies danger to said second portable terminal based on at least one of conditions selected from a location where accidents frequently occur including a construction site, changes in weather conditions, frequency of the occurrence of accidents and traffic conditions.

* * * * *